US007159381B2

(12) United States Patent
Rowan

(10) Patent No.: US 7,159,381 B2
(45) Date of Patent: Jan. 9, 2007

(54) PROCESS AND SYSTEM FOR PRODUCING TIRE CORDS

(75) Inventor: Hugh H. Rowan, Midlothian, VA (US)

(73) Assignee: Performance Fibers, Inc., Richmond, VA (US)

( * ) Notice: Subject to any disclaimer, the term of this patent is extended or adjusted under 35 U.S.C. 154(b) by 1 day.

(21) Appl. No.: 11/093,320

(22) Filed: Mar. 29, 2005

(65) Prior Publication Data

US 2005/0249949 A1 Nov. 10, 2005

(51) Int. Cl.
*D01H 13/10* (2006.01)

(52) U.S. Cl. ..... 57/292

(58) Field of Classification Search ..... 57/234, 57/242, 251, 258, 292, 295, 296, 297, 58, 57/52

See application file for complete search history.

(56) References Cited

U.S. PATENT DOCUMENTS 4,250,702 A * 2/1981 Gundlach ..... 57/251
4,987,030 A * 1/1991 Saito et al. ..... 428/373

* cited by examiner

*Primary Examiner*—Shaun R. Hurley
(74) *Attorney, Agent, or Firm*—Rutan & Tucker, LLP

(57) ABSTRACT

A method and system of manufacturing reinforcement materials for rubber products, particularly tires. The method comprises the steps of twisting two or more yarns together to form a cable, and directly after twisting, applying and cuing an adhering agent to the cable to form a treated cord. The steps of twisting the yams and applying and cuing the adhering agent are performed on one machine without intermediate take-up. The invention is also directed to a system for producing treated cord, the system comprising a one-machine twist and treat unit.

23 Claims, 9 Drawing Sheets

PROCESS AND SYSTEM FOR PRODUCING TIRE CORDS

CROSS-REFERENCE TO RELATED APPLICATIONS

This application claims priority to pending U.S. provisional application Ser. No. 60/292,674, filed May 21, 2001, the entire contents of which are incorporated by reference.

FIELD OF THE INVENTION

This invention relates generally to methods of manufacturing reinforcement materials for rubber products and, more specifically, to methods of and systems for producing treated tire cord. This invention further relates to products made by such methods.

BACKGROUND OF THE INVENTION

The manufacture of reinforcement materials for rubber products, especially for tire cords, has been the subject of a great volume of research and innovation. This effort has focused on a number of facets, among which are concerns to produce better performing products while meeting the constantly demanding economic cost objectives of the global industry.

Alternative constructions have been proposed and patented for reinforcement materials in rubber articles and in particular rubber tires, such as modified cross-section monofilaments (DuPont Hyten®) or zero twist multifilament ribbons (Yokohama). However, the use of tire cords made from high tenacity organic fibers, such as rayon, nylon, aramid and polyester in a construction of moderate twist has remained the principal reinforcing method. High tenacity organic fibers impart improved fatigue properties and, when coated with an adhesion promoting agent, achieve excellent bonding to the surrounding rubber in the curing process for the manufactured article.

Traditional individual process steps for the production of a polyester- or nylon-based tire cord include the typical handling of materials from process machine to process machine within a facility and typical shipment from facility to facility between fiber producer, textile converter, treating unit, and tire builder. Obviously, these conventional processes involve a number of individual steps and multiple transfers of product and are both labor and cost intensive. In many instances involving traditional production processes, the cost of the treated cord is more than double the basic cost of producing the high tenacity fiber itself. Moreover, these conventional processes employ ply and cable twist machines, which at one time were prevalent as the standard.

Industry developments in the recent past have yielded changes to these traditionally treated tire cord production processes. For instance, the conversion industry in many cases is replacing old ply and twisting equipment with direct cable machines. These machines combine the ply and twisting step into one operation, thus rendering the tire cord production process more efficient and cost effective. Further, these machines produce larger package sizes and improve quality by requiring fewer knots or splices in the final cord product.

The methods used to build tires also have undergone significant developments. In many cases, current methods employ single-end treated cords rather than cut plies of a woven coated fabric as tire carcass reinforcement feed materials to the tire building machines. While the latter significantly reduces the space required and the cost incurred to build tires, the economics of traditional single-end treating processes are expensive.

The current invention addresses further major advancements in these manufacturing processes. Using recent developments in fiber production technology and adhesion chemistry, the key steps of converting a high tenacity fiber to a cabled, treated cord, having the physical and chemical properties needed to reinforce rubber products, can be carried out in a one-machine process. This eliminates the multiple package handling and multi-million dollar capital requirements for separate cord and fabric treating units. By the correct selection of each individual element, using the best individual technology, a satisfactory cabled treated cord may be produced very economically on a single machine, termed a one-machine cabled and treated cord unit ("OCT").

The high tenacity organic fiber used in an OCT unit is selected and produced with physical properties such that when cabled and given a short term heat curing, the properties of the cord are satisfactory for the targeted end use. Individual feed yarns may be pretreated with adhesion promoters in their respective production processes or the individual feed yarn may be coated with adhesion promoters on the OCT unit. Individual feed yarns are cabled in a direct cable sub-unit, but the raw cabled cord so made is fed forward directly to a treating sub-unit without any prior package take up. The raw cabled cord is coated with an adhesion promoting dip. The coated raw cord is pulled through a heating unit under controlled tension, operated to achieve a desired temperature for a particular residence time to cure the adhesion dip prior to winding the treated cord on a package. Once packaged, the treated cable cord is delivered to product storage, preferentially by an automated conveyor pack out unit, prior to transfer out to customers or for further processing or manufacture.

SUMMARY OF INVENTION

The invention is directed to a method for producing a treated cord comprising the steps of twisting two or more yarns together to form a cable cord and, directly after twisting the yarns, applying and curing an adhering agent to the cable cord to form a treated cord. The steps are performed on one machine without intermediate take-up.

The invention is further directed to a system for producing treated cord, the system comprising a one-machine twist and treat unit.

Still further, the invention is directed to a system for producing treated cord. The system comprises a cabling unit adapted to twist feed yarns into cord, a treating unit adapted to apply and cure an adhering agent to the cord to form a treated cord, and a feeding unit adapted to forward the treated cord directly from the cabling unit to the treating unit without any intermediate take up.

DETAILED DESCRIPTION OF THE INVENTION

Using recent developments in fiber production technology and adhesion chemistry, the key steps of converting a high tenacity fiber to a cabled, treated cord, having the physical and chemical properties needed to reinforce rubber products can be carried out in a one-machine process. This eliminates the multiple package handling and multi-million dollar capital requirements for separate cord and fabric treating units.

For a fuller understanding of the present invention, it will be useful to review and describe some conventional cord manufacturing and treating processes. Turning now to the drawings in general and to FIG. 1 in particular, there is shown schematically a conventional process 10 for producing treated tire cord. It will be appreciated that the process for producing treated tire cords requires considerable handling between operations and/or production points within a single plant or facility. It further will be appreciated that transport and shipping of the yarns or cords so produced is required between the various segments of the production process. For example, where the manufacturer of the yarn and the converter of the yarn into cable are different entities, a transport operation between entities is required. Furthermore, even when the manufacturer and the converter are the same entity, transport between production facilities is required. To facilitate this understanding, FIGS. 1, 2 and 3 contain legends wherein a circle represents a handling point for handling fiber, yarn, cable, cord fabric or textile within a single phase of production and wherein a square represents a transport or shipping point for fiber, yarn, cable, cord, fabric or textile from one phase of production to another.

Figure 1:
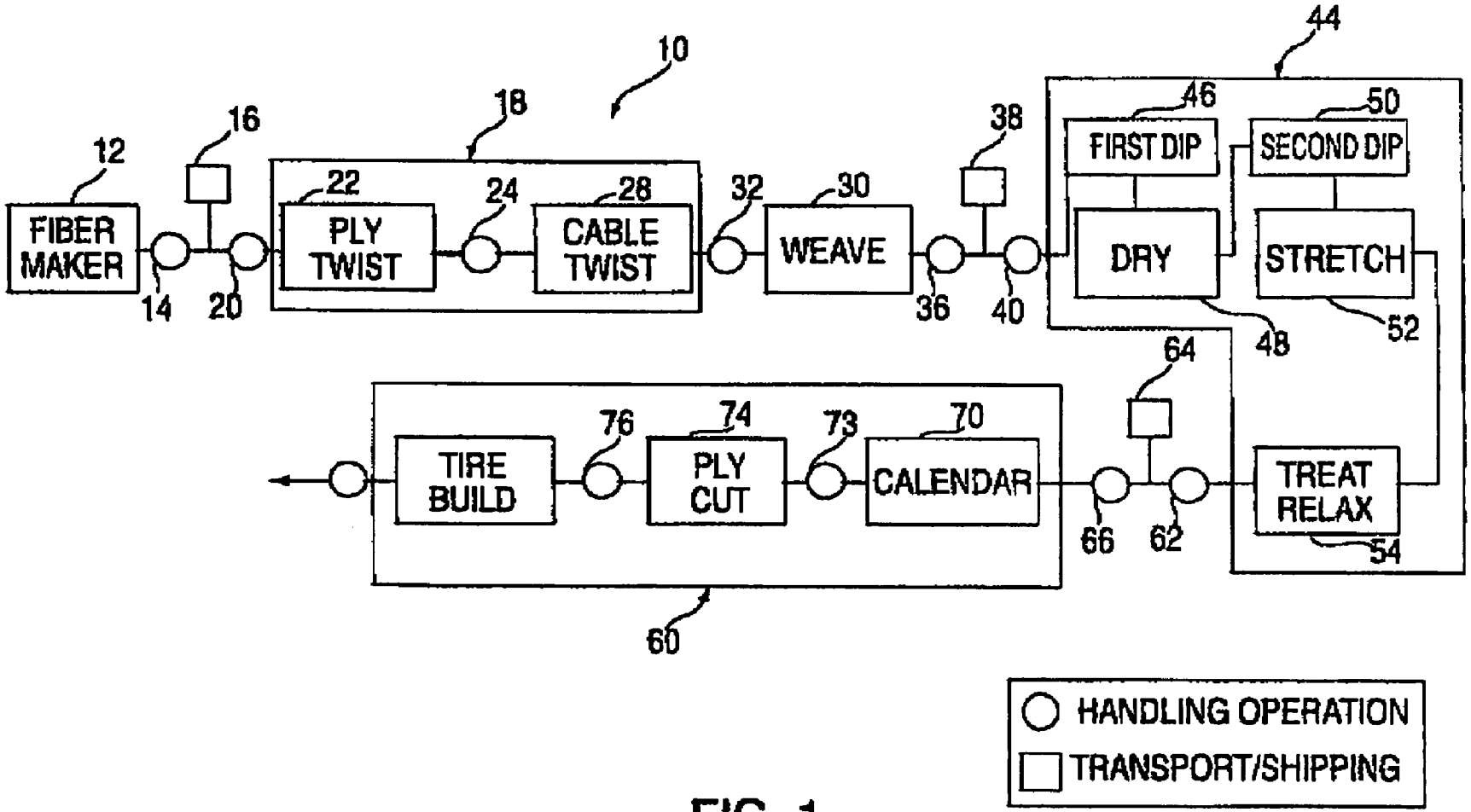
FIG. 1 (PRIOR ART)
FIG. 1 is a flow process diagram of a conventional process for manufacturing treated reinforcing cord for rubber tires, the process comprising one in which ring twisting machines are employed.

The process 10 of FIG. 1 begins with the manufacture of a yarn by a fiber producer at a manufacturing facility 12. As used herein, "yarn" is a generic term for a continuous strand of textile fibers, filaments or materials in a form suitable for twisting, knitting, weaving or otherwise intertwining into a cord or cable or a textile fabric. The yarns so produced are spooled or packaged for transport to a customer, typically via a beamer or warper, at handling operation 14 and then moved or shipped at transport point 16 from the fiber producer 12 to a conversion facility 18.

From transport operation 16, the converter 18 receives the packaged yarn at handling point 20. With some conventional methods of tire cord manufacturing, the converter 18 employs a ring twist machine to produce a cable in two steps, commonly known as the "ring twist process." The yarn is twisted into a ply at point 22. As used herein, "ply" means a twisted single yarn. As used herein, the term "twisting" means the number of turns about its axis per unit of length of yarn or other textile strand. Thereafter, the ply is moved within the conversion facility 18 at handling point 24 to be twisted into a cable of two or more plies with twisting equipment 28.

Thus, with some conventional methods, the conversion of the yarn into a cable is a two-step process consisting of separate and independently operated machines dedicated respectively to twisting the yarn into a ply at point 22, moving the ply to the twisting equipment at handling point 24, and then twisting the ply into a cable on a separate machine at point 28. As used herein, a "cable" or a "cord" means a product formed by twisting together two or more plied yarns. It will be fully appreciated that this two-step ring twist process is laborious and expensive.

It is important to note that the cable at this point has not been treated. Consequently, the cable remains in a raw state and is commonly referred to as greige cord or cable.

With continuing reference to FIG. 1, upon completion of the ring twist operation 18, the greige cable may then be woven into a fabric at weaving operation 30. This operation necessitates additional movement between equipment, as illustrated at handling point 32. The process of weaving tire cord into a fabric is known to the person skilled in the art.

Inasmuch as the woven greige fabric is untreated and hence is not prepared for use in any particular end use application, additional handling and transport operations 36, 38 and 40 are required to move the untreated fabric from the weaving equipment 30 to the treating equipment 44. During the treating step 44, the greige fabric is prepared for a particular end use application.

A traditional dipping process for a standard polyester tire yarn is typically referred to as a double dip or two-zone treating process. A first dip application 46 of a treating agent, selected with the desired end use in mind, is applied to the greige fabric. As used herein, the terms "dip" or "dipping" mean immersion of a fiber, yarn, cord, cable fabric, or textile in a processing liquid. The phrase "treating agent" means materials, which cause fibers, yarns, cords, cables, fabrics or textiles to be receptive to a bonding agent. This chemical dip 46 prepares the surface of the fibers comprising the fabric to receive a coating of a second chemical, in a manner yet to be described, which enables bonding of the fabric to rubber. Typical treating agents may include a solution of a blocked diisocyanide. The treated fabric is dried by heating equipment, as indicated at reference numeral 48 of FIG. 1. Heating equipment suitable for this purpose is generally known in the art and is manufactured by Litzler Corporation and Zell Corporation, for example.

Following the first dip 46 in the treating agent and the drying stage 48, the fabric is subjected to a second dip operation 50. It will now be appreciated that the treating agent from the first dip 46 sizes the fabric in preparation for receiving the bonding agent at the second dip operation 50, wherein a bonding agent, such as a stabilized Resorcinal- Formaldehyde-Latex (RFL), is applied to facilitate adhesion of the fabric to rubber. This is an essential step since the untreated cord typically does not adhere well to rubber and a bonding agent may be desirable to accomplish this objective. As used herein, the phrase "bonding agent" means materials, which cause fibers, yarns, cords, cables or fabrics to adhere or stick together or to other materials.

Following the second dip operation 50, the treated fabric is stretched and relaxed with heat, as shown at reference numerals 52 and 54 of FIG. 1, in order to cure the dip and to set the twist in the cable comprising the fabric. This enables the treated fabric to remain stable and to resist or reduce shrinkage when exposed to higher temperatures during subsequent manufacturing processes. The fabric at this point comprises a treated fabric and is now ready for use in a rubber article of manufacture.

With continuing reference to FIG. 1, it is shown that the treated fabric is now ready for transport to a manufacturer, such as a tire manufacturer 60. The treated fabric undergoes handling and transport operations, shown by reference numerals 62, 64 and 66. The tire manufacturer 60 calendars the treated fabric at calendaring operation 70 by laminating both sides of the fabric with a rubber stock to form a ply. Procedures for calendaring and forming a ply are known in the art. The ply is moved from the calendaring equipment 70 via handling operation 73 to be cut for a specific use or design, as shown at point 74. The cut ply is then handled at point 76 for manufacture and construction of a tire.

Figure 2:
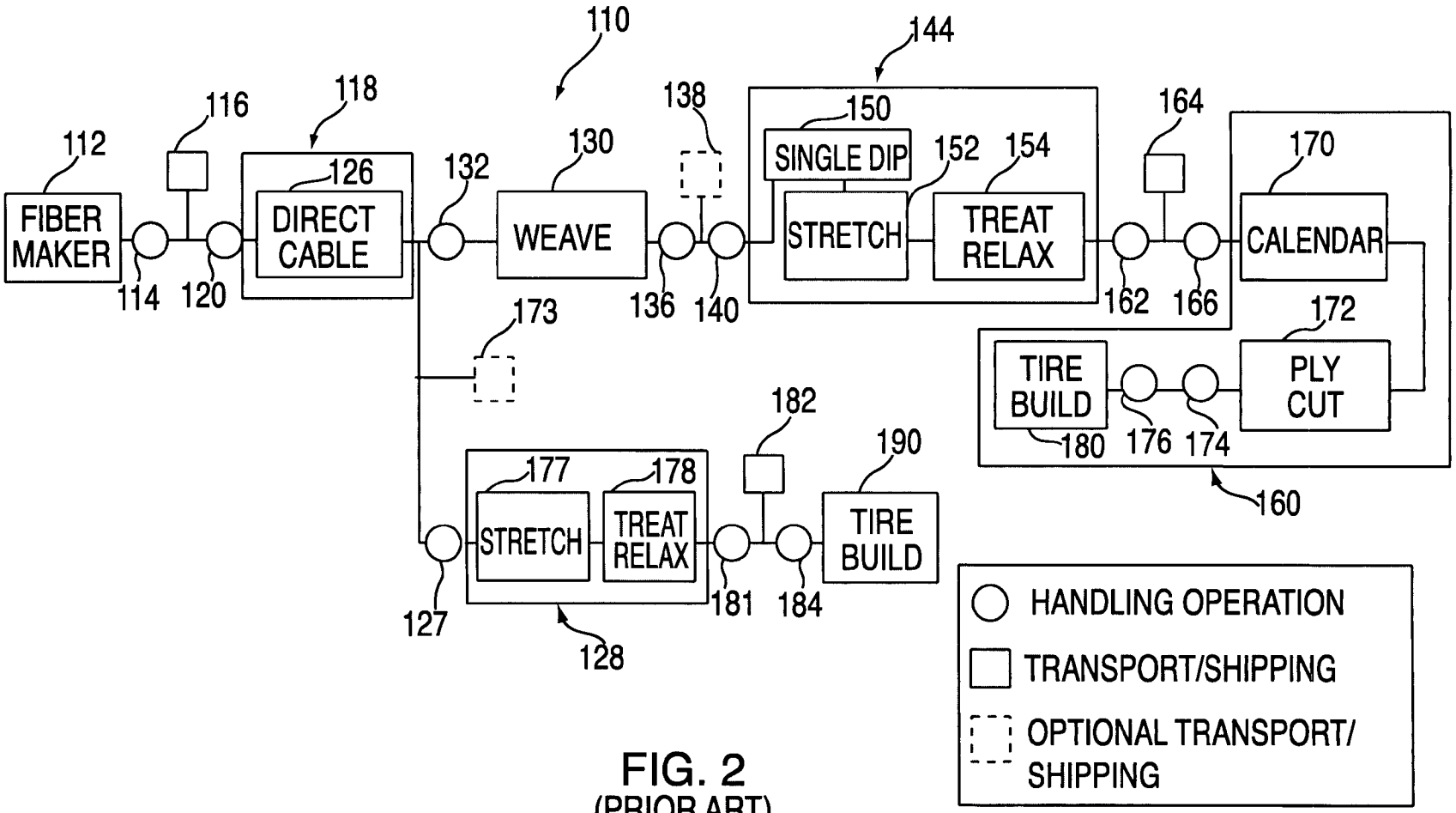
FIG. 2 (PRIOR ART)
FIG. 2 is a flow process diagram of another conventional process for manufacturing treated reinforcing cord for rubber tires, the process comprising one in which a direct cable machine is employed.

Turning now to FIG. 2, a flow diagram for an alternative, more recent conventional process 110 for manufacturing tire cord is shown, wherein an improvement is incorporated into the manufacture of the treated cord. FIG. 2 also contains a legend wherein a circle re presents a handling point for handling of the yarn, cable or cord within a single phase of production and a square represents the transport or shipping point for a yarn, cable or cord from one phase of production to another.

The process 110 of FIG. 2 begins with the manufacture of a yarn by a fiber producer 112. In this instance, the manufacturer 112 produces a fiber that is pre-treated during the production process to yield a high tenacity adhesion-activated organic fiber. This fiber may be selected and produced with physical properties such that when twisted into a cable and given a shorter-term dip and heat curing at a selected temperature and time, the physical properties of the fiber, and ultimately of the cord or woven fabric, are satisfactory for the targeted end use.

From the fiber manufacturing facility 112, the fiber is moved via handling and transport operations 114, 116 and 120 to the conversion facility 118 where the fibers are twisted into cables. The conversion industry in many instances now has replaced the ring twist operations with equipment that combines both steps into a single machine, commonly referred to as a direct able unit ("DCU") 126. This combination significantly reduces the cost and space required in the conversion operation. The construction and operation of such machines is yet to be described herein.

It will be appreciated that the raw cord may be transferred from the DCU 126 to the weaving equipment 130 via handling operation 132. Again, as with process 10 illustrated in FIG. 1, the greige fabric is untreated and, therefore, must be moved from the weaving equipment via handling and transport operations 136, 138, and 140 to treating equipment 144. It now will be appreciated that the use of pretreated yarns eliminates the need for the first dip treatment with a bonding agent. Rather, since the fabric is composed of pre-treated yarns by the fiber maker 112, the treating operation 144 consists only of the second dip operation 150 and the heat treating operation 152 and relax operation 154, wherein a bonding agent is applied to the fabric and cured in order to facilitate adhesion to rubber. The dipped fabric is stretched and then relaxed with heat as indicated at reference numerals 152 and 154. The fabric is now ready for transport to the tire manufacturing facility 160 via handling and transport operations 162, 164 and 166. The treated fabric is calendared and ply cut at operations 170 and 172, respectively. The plies are then moved via handling operations 174 and 176 to the tire manufacturer 180.

With continuing reference to FIG. 2, it is shown that the cord from the DCU 126 alternatively may be treated directly as cord, rather than woven into fabric. To that end, cord may be transferred from the DCU 126 at handling operating 172 and optional transport operation 173 to single-end cord treating equipment 170. The cord is treated with a suitable bonding agent at point 176, in a manner similar to that described at operation 50 from FIG. 1, before applying heat treatment, stretch and relaxation operation 178. The treated cord is then wound up on individual packages and transferred via handling and transport operations 180, 182 and 184 to the tire manufacture 190 for construction of a tire or other reinforced rubber article. Single end cord treating units which handle many cords simultaneously are well know in the art but are expensive in cost per pound treated.

Figure 3:
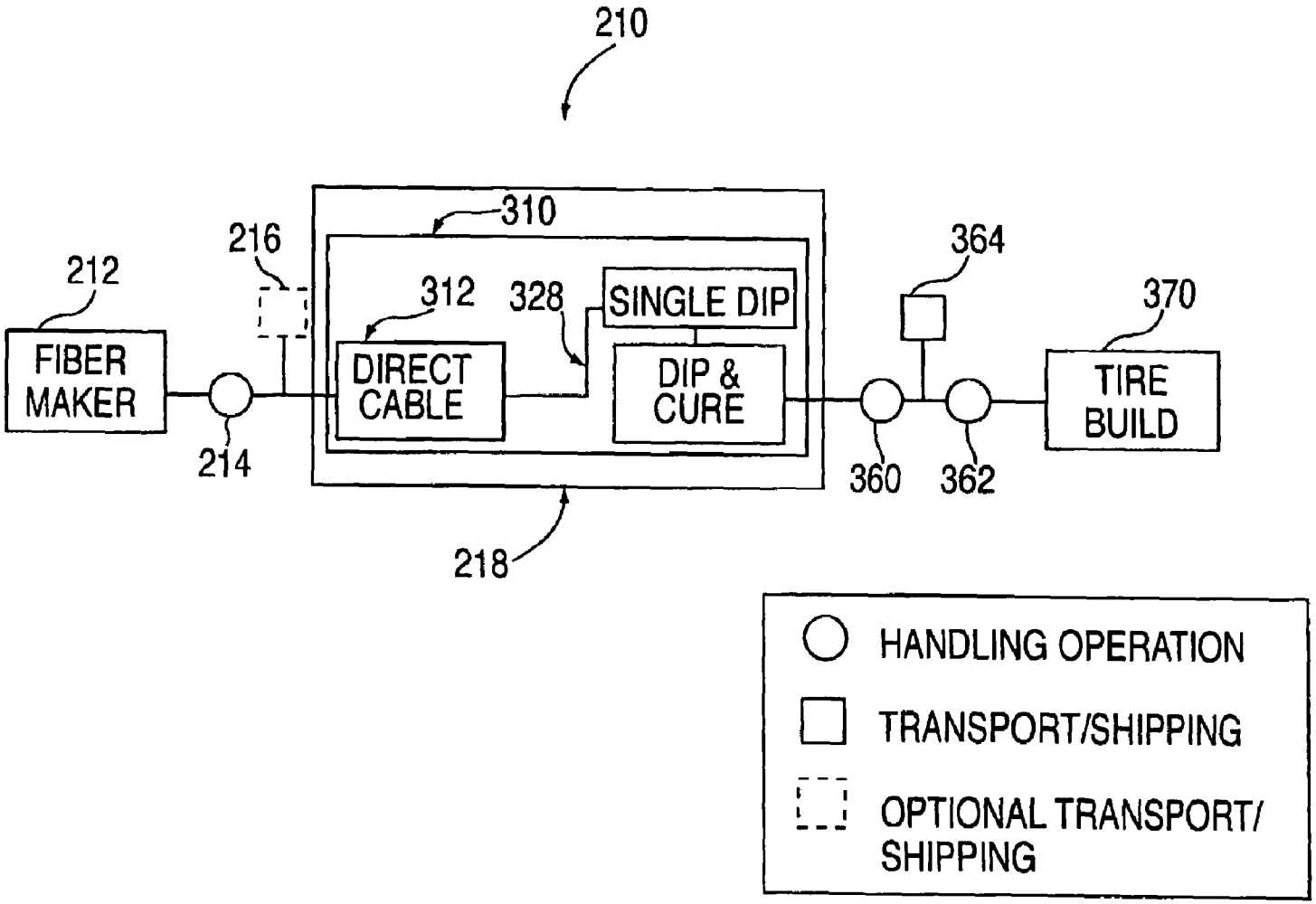
FIG. 3 is a schematic illustration of the process of the present invention for manufacturing treated cord, the process comprising one in which an one-machine cable and treating unit is employed.

With this understanding of some conventional cord manufacturing processes, attention is now directed to FIG. 3 wherein the system and process 210 of the present invention is described. The present invention comprises a one-machine twist and treat process 210 that eliminates many of the labor intensive and costly handling and transport operations required in the conventional manufacturing processes 10 and 110. By the correct selection of each individual element, using the best individual technology, a satisfactory cabled treated cord may be produced very economically on a single machine.

The process 210 begins with the production of a yarn by the fiber producer 212. The fiber producer 212 may produce a yarn that is treated during the production process to yield a high tenacity organic fiber. The high tenacity fiber may be selected from a wide variety of available synthetic materials, including nylons, polyesters, aramids, and other high performance polymers such as PBO. In addition, natural-based materials, such as rayon, may be used to produce the treated fiber. One such pre-treated yarn suitable for this purpose is a polyester-based yarn which is dimensionally stable. This yarn is known as 1×53, and sold by Honeywell International as DSP® yarn. As used herein, dimensional stability means the ability of a textile material to resist shrinkage during heating and reduce extension under force. Polyester yarns of this type are commonly referred to as high modulus, low shrinkage ("HMLS") yarns. Alternatively, copolymers of materials, particularly as bi-component or sheath/core fibers, may also be used to achieve highly satisfactory results.

The individual feed yarns may be pre-treated with adhesion promoters, or bonding agents, during the respective production processes. In one preferred process, this yarn may be selected and produced with physical properties such that when cabled and given a short term beat curing, at approximately 200 degree. C. for 30 second or less, the physical properties of the fiber and ultimately of the woven cord are satisfactory for the targeted end use. The high tenacity fiber may be selected from a wide variety of available synthetic materials, including nylons, polyesters, aramids, and other high performance polymers such as PBO. In addition, natural-based materials, such as rayon, may be used to produce the treated fiber. Alternatively, copolymers af materials, particularly as bi-component or sheath/core fibers, may also be used to achieve highly satisfactory results. Methods and products for making pre-treatcd, high tenacity, organic fibers are set forth in U.S. Pat. No. 5,067,538 and U.S. Pat. No. 4,652,488, the entire contents of which are incorporated by reference. It also will be appreciated that the fiber producer 212 may produce an untreated yarn, and the process of the present invention is also useful in the manufacture of cord using untreated yarn.

Individual feed yarns may be pretreated with adhesion promoters in their respective production processes (e.g. PET) or the individual feed yarn may be coated with adhesion promoters on the cabling machine in a manner yet to be described. Some suitable adhesion promoters are based on various epoxy compounds, such as epoxysilane, and are described in U.S. Pat. No. 5,693,275 and U.S. Pat. No. 6,046,262, the entire contents of which are incorporated by reference. With continuing reference to FIG. 3, from the fiber manufacturer 212, the fiber is moved via handling operation 214 and optional transport operation 216 to the conversion operation 218, which comprises a one-machine cabled and treated cord unit ("OCT") 310. The OCT 310 cables and treats the cord in a continuous process without intermediate take-up in a manner yet to be described. The treated cord may then moved via handling and transport operations 360, 362 and 364 to the tire manufacturer 370.

Figure 4:
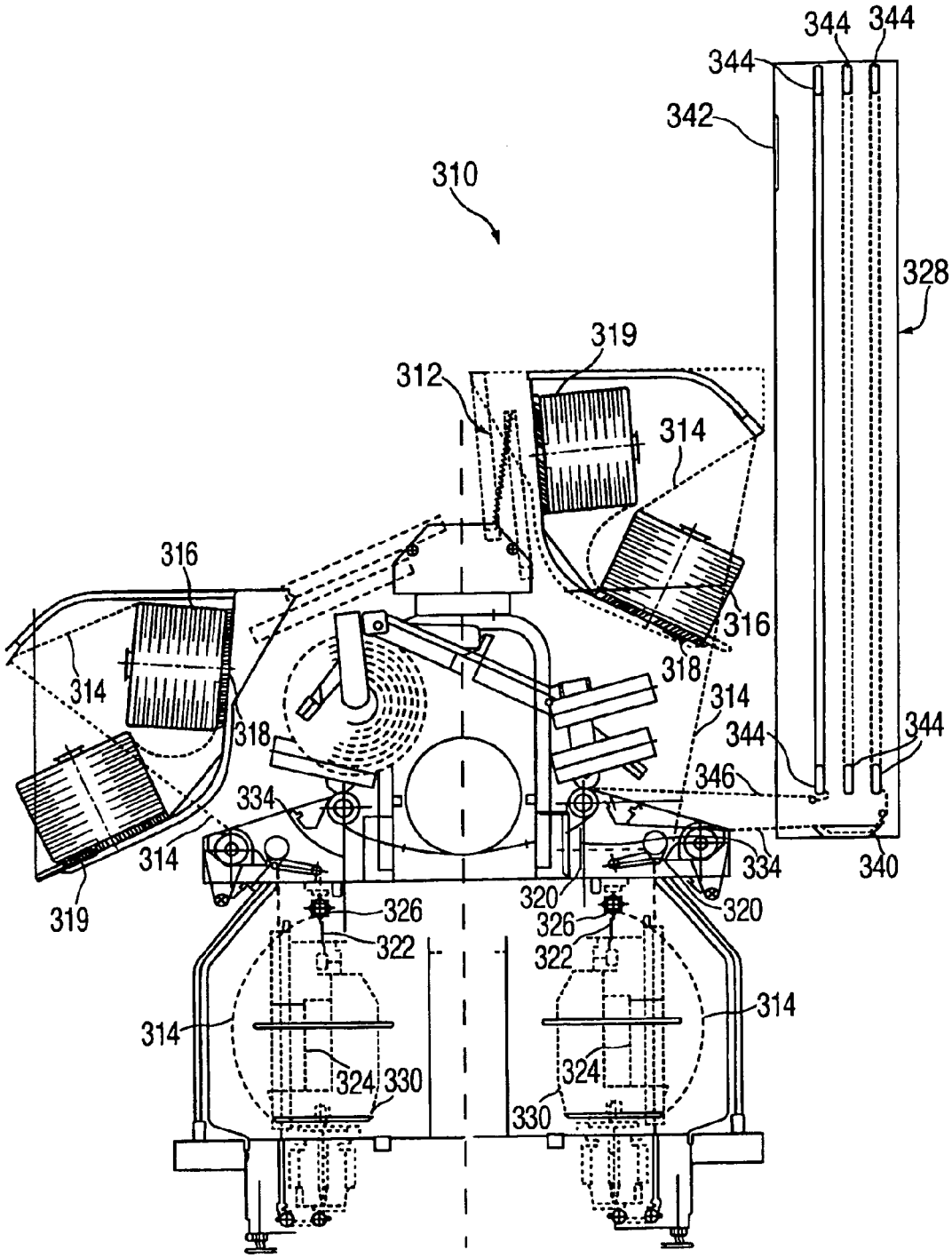
FIG. 4 is a front elevational view of a one-machine cable and treating unit of the present invention, the one-machine cable and treating unit comprising a direct cable subunit and a treating subunit. A direct cable machine is shown on the left side of FIG. 4, while one-machine twist and treat unit is shown on the right side.
Figure 5:
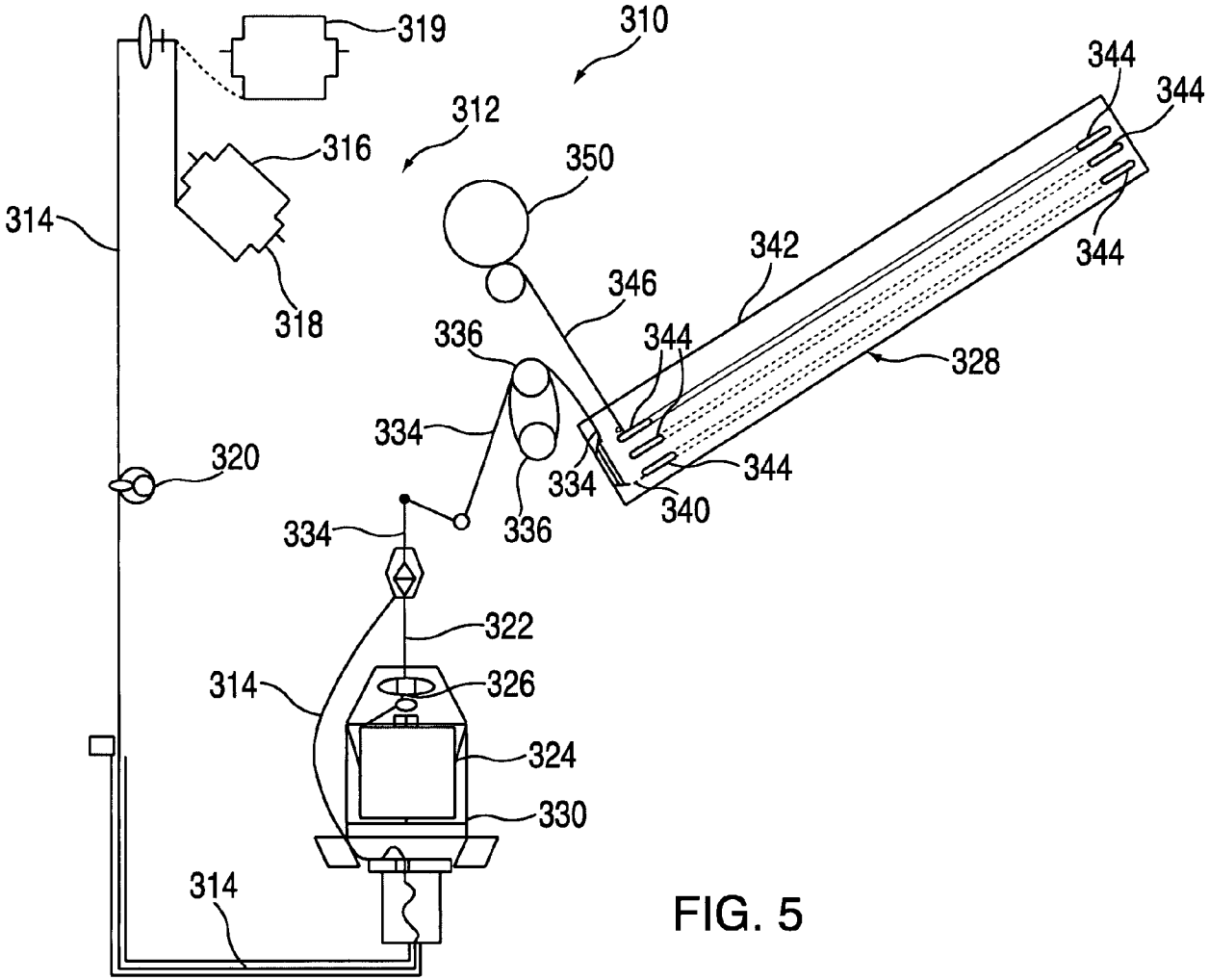
FIG. 5 is a schematic of a one machine cabled treated cord unit.

Attention is now drawn to FIGS. 4 and 5 wherein the function and operation of an OCT 310 is illustrated. The OCT comprises a direct cable subunit ("DCU") 312 and a treating subunit 328. The OCT eliminates the need for intermediate take-up of the cable by feeding cable, in a manner yet to be described, directly from the DCU 312 to the treating subunit 328 via a system of tensioning devises.

Yarns for producing a cable first may be processed tbrough the DCU 312. In so doing, an outer yarn 314 is pulled from the supply package 316 located in the bobbin creel 318 or reserve bobbin creel 319. The outer yarn 314 as pretensed by a tensioning device, such as brake 320. It will be appreciated that other rensioning devices, such as paired driver rolls, skewed rolls, adjustable finger or ladder units, computerized tension measuring devices, whether online, manual, computerized or otherwise, maybe substituted for or used in conjunction with the brake 320. It will be appreciated that a number of devices may be adapted to pretense the yarns for twisting.

With continuing reference to FIGS. 4 and 5, the inner yarn 322 is drawn and unwinds from the inner supply package 324 which is held in stationary spindle container 330. The tension in the inner yarn 322 is controlled again by a tensioning device, such as brake 326. The tension in the inner yarn 322 may be correlated with the tension in the outer yarn 314 set by brakes 320 and 326. Tension is measured and maintained via tension measuring devices known in the art and may be correlated manually, online or via computer software, or other means. It again will be appreciated that other tensioning devices, such as paired driver rolls, skewed rolls, adjustable finger or ladder units, may be adapted to, substituted for or used in conjunction with the brake 326.

The outer yarn 314 and the inner yarn 322 are twisted into a cord 334 as the yarns 314 and 322 pass through spinning discs 336, which act to even-any remaining differences in lengths between the yarns prior to twisting.

With continuing reference to FIG. 4, the treating subunit 328 of the OCT 310 eliminates the handing and transport operations 32, 36, 38 and 40 of process 10 in FIG. 1 and handling and transport operations 132, 136, 138, 140 and 172 of process 112 shown in FIG. 2. Individual feed yarns 314 and 322 are cabled in the DCU 312 but the raw cabled cord 334 so made is fed forward directly to a treating sub-unit 328 without any prior package take up. This is accomplished by connecting the treating subunit directly with the DCU 312 and controlling the tension on the cord as it proceeds from the DCU to the treating sub-unit 328.

Heretofore, the cord treating equipment has been kept separate to achieve the targeted level of adhesion for the desired end property and use and the desired levels of physical and chemical performance.

With conventional processes, to achieve uniformity of target properties for individual cords with low modulus materials, whether in single end or fabric based treating units, it was considered necessary to perform a stretch then a relax operation on the cord. The stretch and relax operation, often preceded by a drying step, used high temperatures and time periods in excess of one minute to achieve the tenacity and shrinkage levels in combination with adequate curing of the bonding agent. This stretch and relax operation are known to those skilled in the art. Typical conditions are given in U.S. Pat. No. 4,491,657, the entire contents of which are incorporated herein by reference, for a Litzler Computreater as dry heating at 160° C. under stress to maintain a consistent length of the cord, then heating in a stretched condition for 120 seconds at 240° C. and for 120 seconds at 240° C. in a relaxed condition. Another example is found in U.S. Pat. No. 5,403,659, the entire contents of which are incorporated herein by reference, which describes using stretches of 2 to 8% and shrinkages of 0 to 4% while heating at 227° C. for 40 to 60 seconds.

The commercial units required to achieve these temperatures, times and tensions, particularly with tire fabrics containing over 1000 individual ends in parallel, are extremely large and expensive with ovens several stories high.

Surprisingly, it is not necessary to use these severe conditions with high modulus materials which are capable of physical property uniformity and with surface chemistry enabling adequate adhesion to be achieved with relatively short time heat treatment at moderate temperatures. The desired properties may be achieved without stretching the cord simply by controlling the tension in the cord to allow for a small heat shrinkage to occur. Using these greige cord parameters and applying the concept to DCU machines yields an unexpected capability to combine dipping and heat treating with the DCU and eliminate the handling and transport operations between these steps.

Commercial DCU machines are limited by the spindle speed achievable. In practice, the maximum spindle speed is about 11000 rpm. For example, typical twist in a tire cord cable is 400 TPM (turns per meter); thus, the cord speed in meters per minute through the machine is 11000 rpm divided by 400, i.e., 27.5 meters per minute. For a 30 second heating time, the total linear distance required will be only 13.75 meters, which can be achieved in a short multi-pass heater.

It now will be appreciated that by controlling the tension on the cord, via the tensioning devices and the speed of the yarns from the DCU 312, to the treating subunit 328, the cord may be fed directly from the DCU to the treating equipment without intermediate take-up, thus eliminating handling and transport operations between these two process steps.

At the treating subunit 328, the raw cabled cord 334 is coated with an adhesion agent, such as a Resorcinal-Formaldehyde-Latex (RFL) for nylon, PET or rayon. RFL may contain catalytic additives to enhance adhesion of the cord to rubber. The adhesion agent may be adjusted or substituted for the type of raw cord. The coated raw cord 334 is pulled through dip tray 340 of the heating unit 342 under controlled tension via a system of tensioning devices 344. In a preferred embodiment, the raw cord 334 may be moved through the heating unit 342 in a number of shorter multiple passes. It will be appreciated that any number alternative designs for moving the raw cord 334 through the heater 342 may be used in the practice of the invention.

The heating unit 342 may comprise an electrical unit, an infrared unit, a radio frequency unit, a microwave unit or plasma, or it may be heated with forced hot air supplied from a central source. It will be appreciated that a number of devices alternative heater designs may be used to heat the cord 334 and may be substituted for the heating unit 342. The heating unit 342 may also comprise an exhaust outlet for removal or release of the by-products from the curing of the dip. A person skilled in the art will appreciate that any number of heating units are suitable for use in association with the present invention and may be adapted to receive the raw cabled cord 334 directly from the DCU 312. In one preferred embodiment, the treating equipment is operated to achieve a temperature of approximately 200° C. for a residence time of approximately 30 seconds or less to cure the bonding agent prior to winding the treated cord 346 on a package or spool 350.

The package take up is preferably by an automatic doffing winder unit; however, any mechanical means adapted to take up the cabled cord is suitable.

The treated cable cord product package 350 is delivered to product storage, preferentially by an automated conveyor pack out unit, prior to transfer to the Tire Production Unit ("TP Unit"). The OTC unit may be located, for example, at:

(i) the fiber producer, to eliminate the packing and shipping of raw fiber, (ii) an independent converter, but requiring much less floor space and total capital cost than traditional treated cord conversion, or (iii) the tire or rubber product manufacturer, particularly where new tire or rubber product building elements based on single cord technology are being installed.

Figure 6:
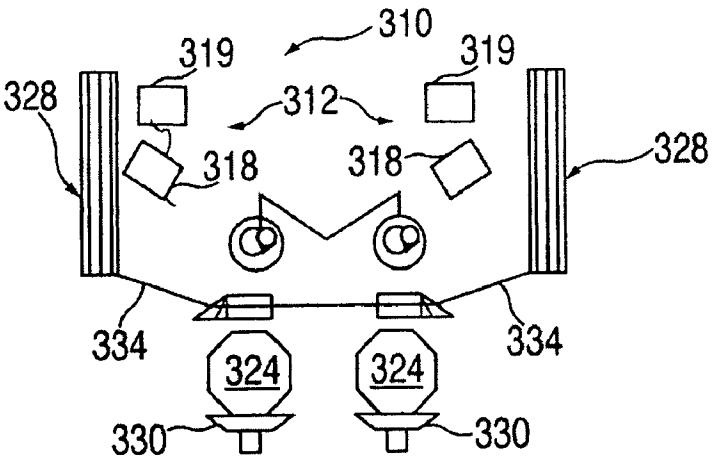
FIG. 6 shows a schematic illustration of a preferred configuration for the direct cable subunit and the treating subunit of FIGS. 4 and 5.

The treating subunit 328 may be constructed as part of the DCU 312 to conserve floor space as shown in FIG. 6. A two-sided OCT 310 is shown with one set of treatment subunits 328 allotted for each DCU 312. The OCT 310 is given a vertical location to minimize the machine space.

Figure 7:
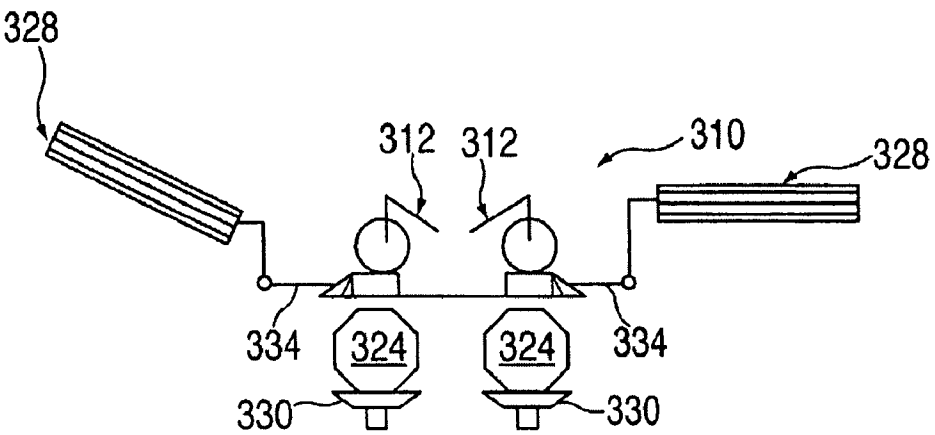
FIG. 7 shows a schematic illustration of an alternative configuration for the direct cable subunit and the treating subunit of FIGS. 4 and 5.

Alternatively, the treating subunit 328 may be configured in an assembly parallel to the DCU 312, as shown in FIG. 7. The treatment subunit may be placed either at an incline or exactly horizontal with respect to the DCU 312. This configuration minimizes the vertical spaced requirement for the OCT 310.

Figure 8:
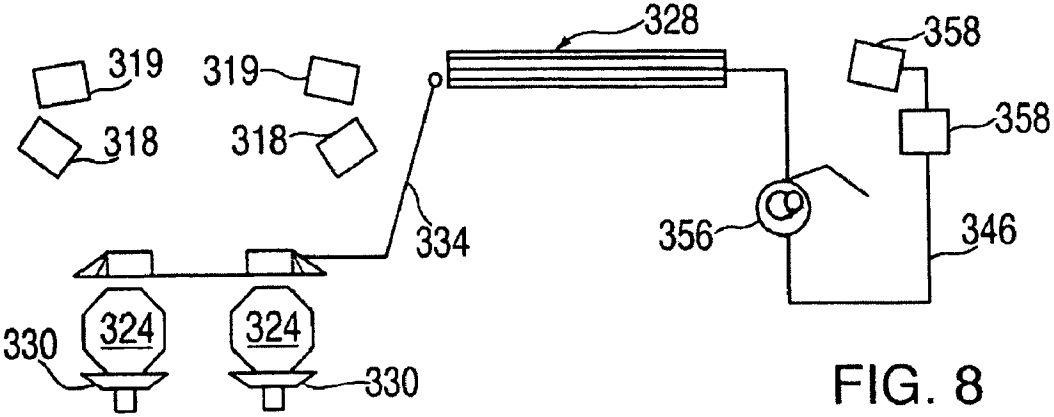
FIG. 8 shows a schematic illustration of an alternative configuration for the direct cable subunit and the treating subunit of Figures and 5.

Additionally, as shown in FIG. 8, a low level take up sub unit 356 may be positioned next to the treating equipment 328 for winding the treated cord 346 onto spools 358.

The practice of the invention is further illustrated by reference to the following examples, which are intended to be representative rather than restrictive of the scope of the invention. Examples to show the achievement of typical treated cord property targets are given for polyester and nylon.

EXAMPLE 1

High tenacity high modulus low shrinkage (HMLS) commercial polyester tire yarn, pretreated by the producer (Honeywell) to achieve good adhesion to rubber stocks (Adhesion Activated 1×53), was obtained as 1440 dtex packages. Two packages were placed in the upper and spindle positions of an ICBT direct cable machine and cabled to produce two ply 410 twist per meter cabled greige cords. The greige cords were then treated in a Zell single end laboratory dipping and treating unit with the operating conditions of speed, number and length of passes in the ovens etc. being adjusted, to achieve the conditions given in Table I.

TABLE I

Single Dip Treating Conditions

| | Drying Oven | | | Curing Oven | | | Relaxation Oven | | |
|---|---|---|---|---|---|---|---|---|---|
| Run No. | Temp. (° C.) | Exp. (Secs.) | Stretch (%) | Temp. (° C.) | Exp. (Secs.) | Stretch (%) | Temp. (° C.) | Exp. (Secs.) | Stretch (%) |
| 1 (Comparative) | 130 | 60 | +0.5 | 235 | 45 | +3.0 | 230 | 45 | −2.0 |
| 2 (Invention Simulation) | Ambient | | — | 180 | 30 | −0.5 | Ambient | | — |
| 3 (Invention Simulation) | Ambient | | — | 200 | 30 | −0.5 | Ambient | | — |
| 4 (Invention Simulation) | Ambient | | — | 220 | 30 | −0.5 | Ambient | | — |

Run 1 of Table I is a comparative example to show a typical current commercial set of conditions for a fabric treating unit and to produce typical cords for measurement of physical and chemical properties desirable for in-rubber end use. Runs 2, 3 and 4 of Table I are examples to simulate the invention OCT treating sub-unit wherein the duration of the heat treatment is reduced to only 30 seconds with the temperature in the oven used at 180° C., 200° C. and 220° C., respectively. In all four runs each cord was treated with a conventional non-ammoniated resorcinol-formaldehyde-latex dip comprising a pre-condensed vinyl pyridine latex, resorcinol formaldehyde, sodium hydroxide and water solution at about 4.5% total solids pickup based on the weights of the cord. The treated cords were then tested for physical properties using an Instron Model 4466 test unit under ASTM D885-84 conditions, with thermal shrinkage carried out using a Testrite Model NK5 at 177° C. for 2 mins. with 0.5 gms/dtex pretension. Adhesion of the treated cords was determined using standard rubber stocks and H-Adhesion tests as defined in U.S. Pat. No. 3,940,544, hereby incorporated by reference. The physical and adhesion results are given in Table II.

TABLE II

| Run No. | Tensile Strength (N) | Shrinkage @ 177° C., 2 mins. (%) | Elongation at Break (%) | H-Adhesion (N) |
|---|---|---|---|---|
| | Treated Cord Properties | | | |
| 1 | 180 | 1.6 | 14.5 | 135 |
| 2 | 179.6 | 2.3 | 16.3 | 117 |
| 3 | 180.3 | 1.8 | 16.1 | 112 |
| 4 | 180.6 | 1.5 | 16.0 | 109 |

EXAMPLE 2

Figure 9:
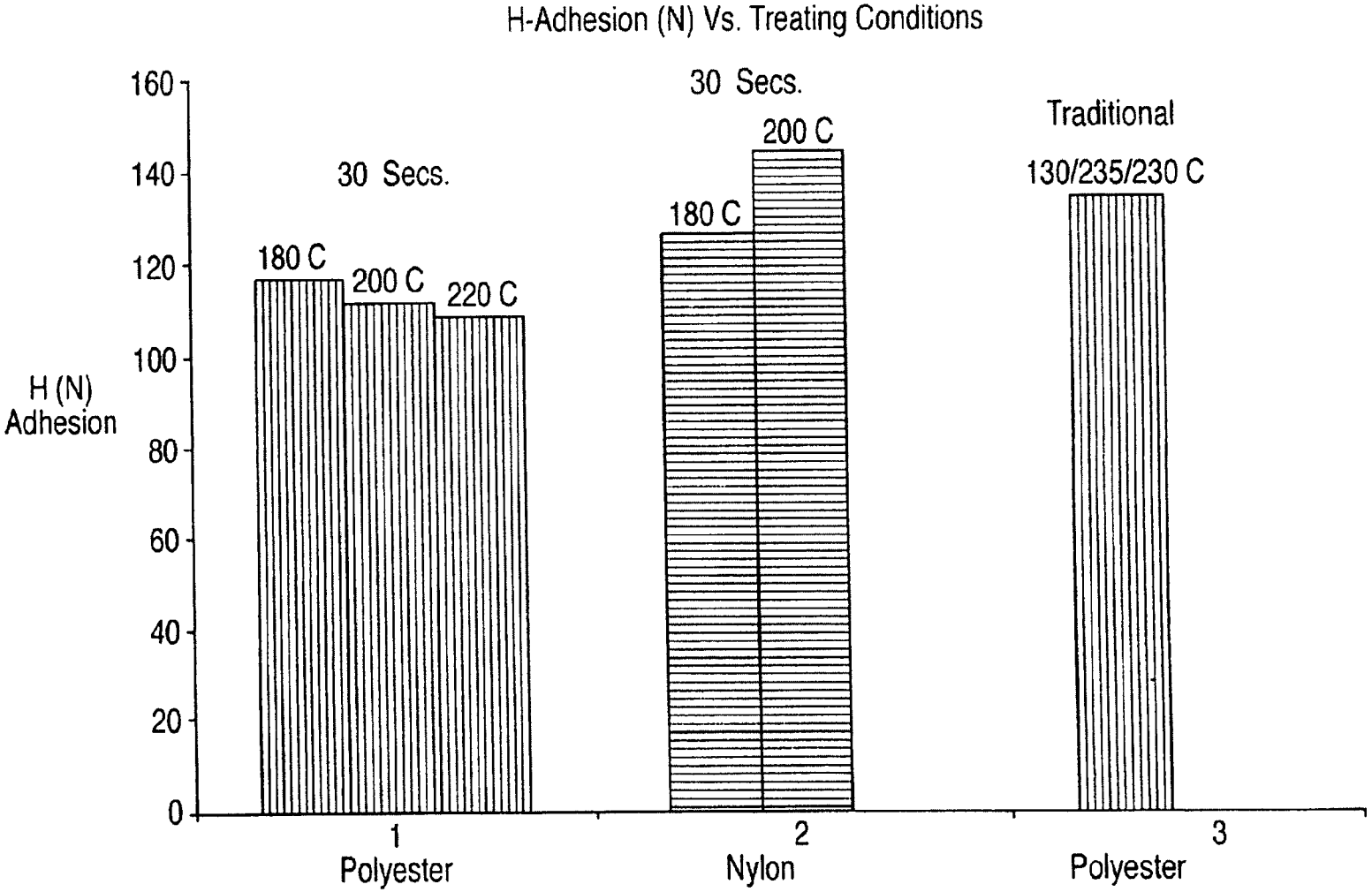
FIG. 9 shows the H-adhesions for polyester and nylon inventive samples and a polyester comparative sample.

Greige cords were produced on the ICBT Direct Cable unit using 1400 dtex Nylon 6 high viscosity high tenacity yarn (IR88 from Honeywell) at a twist level of 380 TPM. The treating conditions to simulate an OCT unit were selected to be 180° C. and 200° C. for 30 seconds following application of the same dip type and level as in Example 1. The H-adhesions were 126 N and 144 N respectively. The adhesion results for Examples 1 and 2 are shown on FIG. 9.

EXAMPLE 3

The polyester greige cords produced as in Example 1 were treated in the simulated OCT unit under the conditions listed in Table III to determine the affects of the treating unit tension (stretch or relax) on the key properties of the treated cord.

TABLE III

| Run No. | Oven Temp. (° C.) | Exposure Time (Secs.) | Cord Tension (N) | Cord Stretch (%) |
|---|---|---|---|---|
| | Effect of Tension on Treated Cord Properties | | | |
| 5 | 200 | 30 | 11 | +2.0 |
| 6 | 200 | 30 | 9 | +1.50 |
| 7 | 200 | 30 | 7 | +0.75 |
| 8 | 200 | 30 | 5 | −0.4 |
| 9 | 200 | 30 | 3 | −2.0 |
| 10 | 200 | 30 | 1 | −5.0 |

Figure 11:
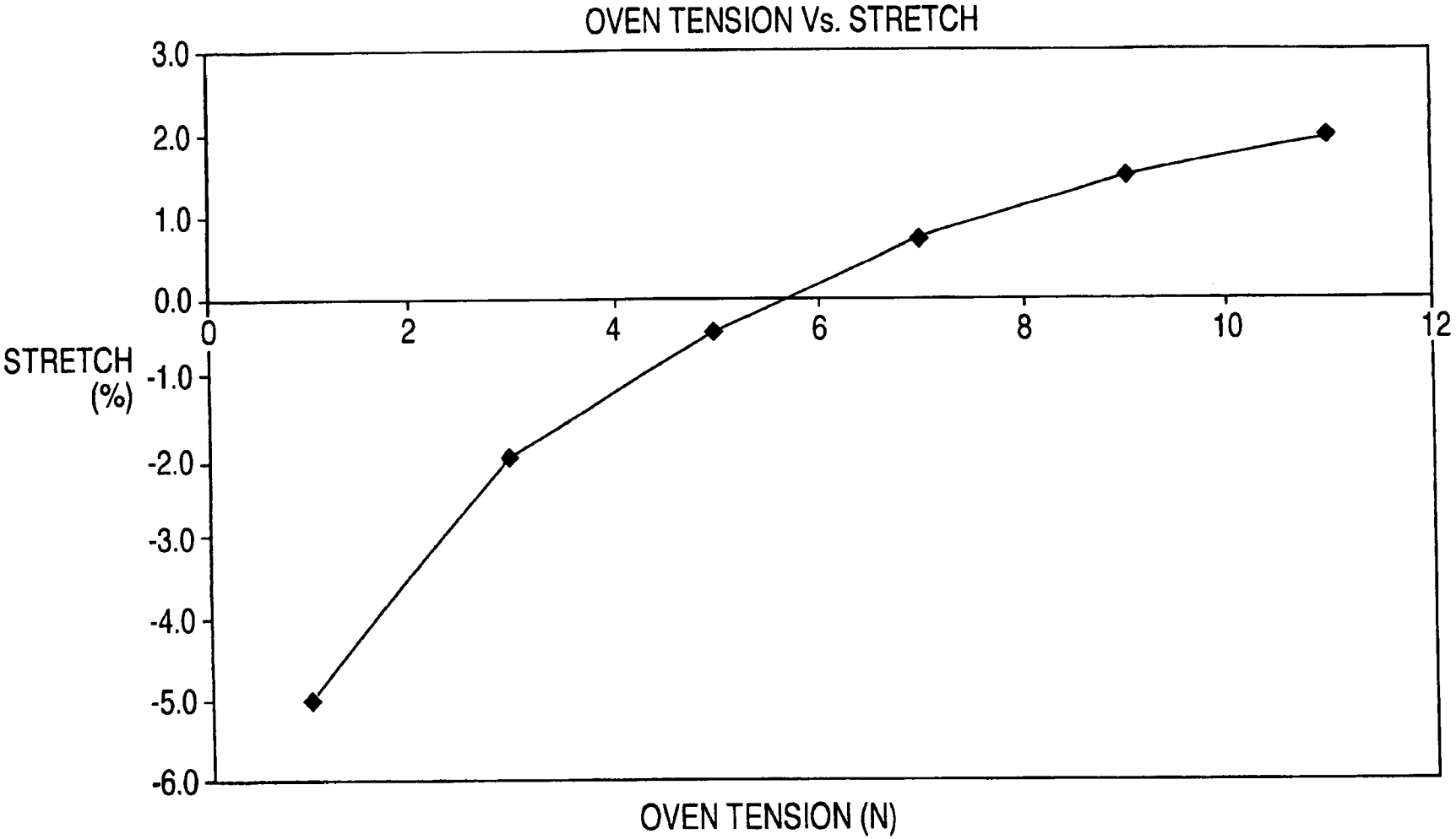
FIG. 11 is a graph of stretch as a function of oven tension for cord treated in accordance with the present invention.

The results for treated cord properties are given in Table IV and shown in FIG. 11.

TABLE IV

| Run No. | Tensile Strength (N) | Thermal Shrinkage (%) | Elongation @ Break (%) | E 45 (N) Cord (%) | E 45 (N) In-Tire (%) |
|---|---|---|---|---|---|
| | Treated Cord Properties | | | | |
| 5 | 180.0 | 3.4 | 13.7 | 2.7 | 4.4 |
| 6 | 177.9 | 3.0 | 14.0 | 2.9 | 4.6 |
| 7 | 179.5 | 2.3 | 15.0 | 3.2 | 4.5 |
| 8 | 180.3 | 1.8 | 16.1 | 3.6 | 4.6 |
| 9 | 177.0 | 1.1 | 17.2 | 4.5 | 4.8 |
| 10 | 177.7 | 0.1 | 20.8 | 6.6 | 5.9 |

To compare with commercially targeted treated cords, a measurement was made of the expected part load modulus of cords after they had been cured in-rubber. This test is as described in Nelson et. al., *Rubber World*, "Dimensionally Stable PET Fibers for Tire Reinforcement," pp. 30–37 (May 1991), and Nelson et. al., 3rd International TechTextile Symposium, "Dimensionally Stable PET Fibers" (May 1991), and is denoted as "In-Tire E45 (N)" in Table IV.

Figure 10:
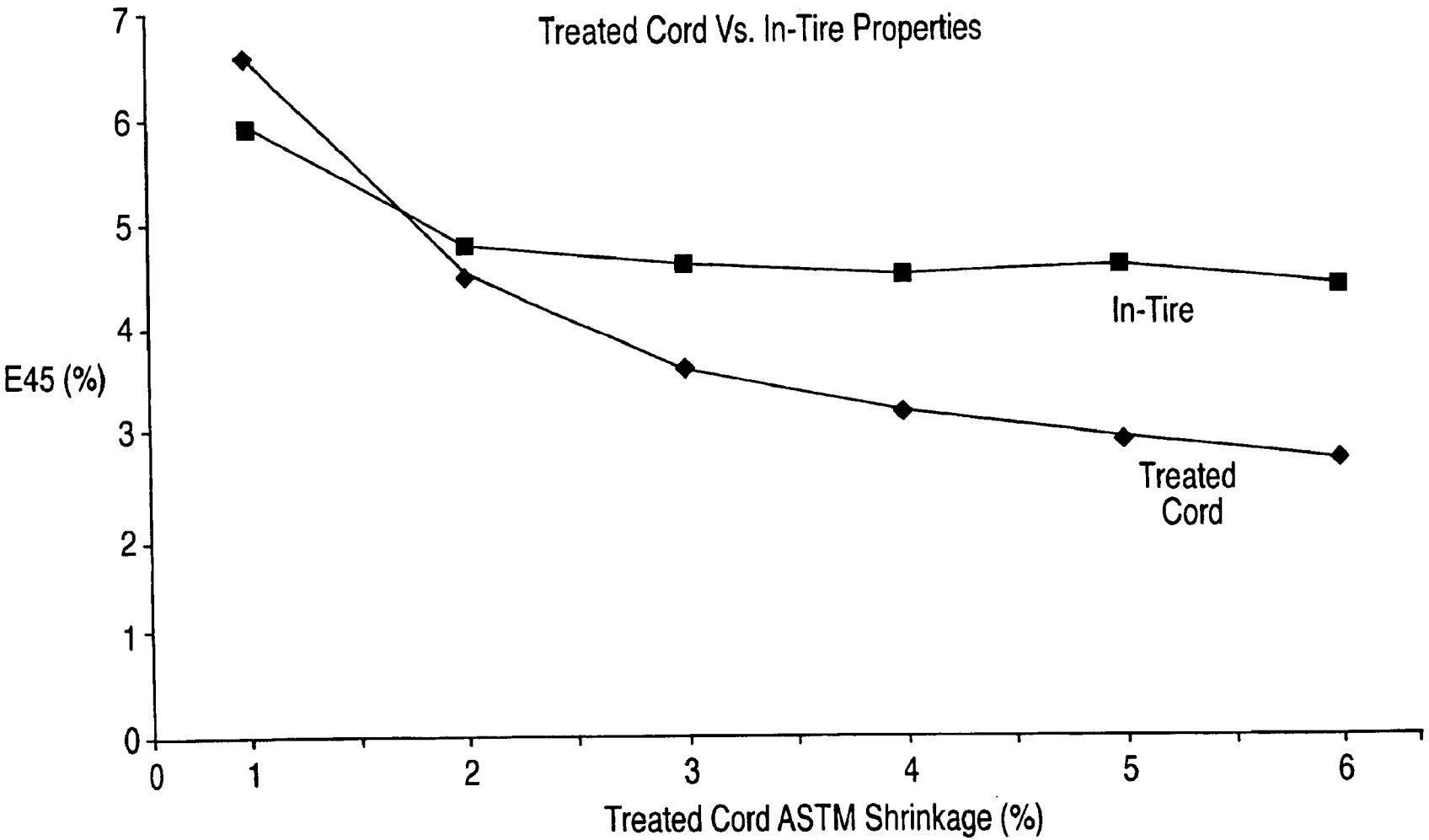
FIG. 10 is a graph of elongation at specified load (EASL) as a function of shrinkage for cord treated according to the present invention and after simulated in-rubber curing.

From FIG. 10, it can be seen that at a treating tension of approximately 4 Newtons the in-tire cord elongation at 45N begins to sharply increase, which is undesirable, while the value for cord shrinkage is at a low level (≦1.5%) and the treated cord elongation at break is attractively high (≧14%) which in combination with the tenacity of the cord produces a very desirable toughness level.

FIG. 11 shows the approximate relationship between tension in the simulated OCT treating sub-unit and the stretch/relaxation at a 200° C. temperature at 30 seconds residence time. A 4 N tension level corresponds to approximately 1% relaxation. Both these tension and relaxation levels are very practical for a one machine unit OCT design.

While certain representative embodiments and details have been shown for the purpose of illustrating the invention, it will be apparent to those skilled in the art that various changes and modifications may be made therein without departing from the spirit and scope of the invention.

What is claimed is:

1. A one-machine cabled and treated cord unit, comprising:

a direct cable subunit configured to twist at least two yarns together to thereby form a cable;

a system of tensioning devices;

a treating subunit coupled to the direct cable subunit and the system of tensioning devices to thereby form a single machine that is configured such that the cable is fed directly and without intermediate take-up, from the direct cable subunit to the ucatnig unit via the system of tensioning devices, and wherein the treating subunit is futher configured to form a treated cord from the cable, and wherein the system of lens oning devices and the treating subunit are further configured such that the cable and the treated cord are not stretched but are tension-controlled to thereby allow for small heat shrinkage.

2. The cord unit of claim 1, wherein the treating unit is configured to apply and cure an adhering agent to the cable to thereby form the treated cord.

3. The cord unit of claim 1, wherein the system of tensioning devices comprises a feeding unit adapted to forward the treated cord directly from the cabling unit to the heating unit without any intermediate take-up.

4. The cord unit of claim 1, wherein the treating subunit futher comprises a heating unit.

5. The cord unit of claim 4, wherein the heating unit comprises an electrical heating unit.

6. The cord unit of claim 1, wherein the treating unit is configured to coat the cable with an adhering unit.

7. The cord unit of claim 6, wherein the adhering agent is a Resoureinol-Formaldehyde-Latex (RFL).

8. The cord unit of claim 7, wherein the RFL contains catalytic additives for adhesion.

9. The cord unit of claim 6, wherein the adhering agent is a latex-based system including the use adhesion promoting or curing compounds.

10. A treated cord produced using the cord unit of claim 1.

11. The cord of claim 10, wherein the cord comprises yarn of organic high tenacity fiber capable of being produced with properties which are satisfactory for rubber reinforcement after twisting but without extensive heat treatment.

12. The cord of claim 11, wherein the yarn comprises an least one of polyesters, polyamides, aramids, and high performance polymers capable of forming a high tenacity fiber.

13. The cord of claim 11, wherein the yarn is a natural-based fiber.

14. The cord of claim 11, wherein the yarn is a fiber made from two or more components.

15. The cord of claim 14, wherein the yarn is a hybrid of two or more component fibers.

16. The cord of claim 15, wherein the fibers are a mixture of polyester filaments and nylon filaments.

17. The cord of claim 11, wherein the yarn is a dimensionally stable, high modulus, low shrink polyester.

18. The cord of claim 11, wherein the yarn is comprised of polyester core/nylon sheath fibers.

19. The cord of claim 11, wherein the yarn is an aramide.

20. The cord of claim 11, wherein the yarn is rayon.

21. A product select from the group consisting of a single-end cord, a plied cord having at least two plies, and a fabric, wherein the product comprises the cord at claim 10.

22. A reinforced rubber article or a tire comprising the cord of claim 10.

23. A reinforced rubber article or a tire comprising the single-end cord or the plied cord having at least two plies, or the fabric of claim 21.

* * * * *